United States Patent [19]

Wentzel

[11] Patent Number: 4,832,497

[45] Date of Patent: May 23, 1989

[54] METHOD AND AN APPARATUS FOR MIXING GRAVEL AND BITUMEN

[75] Inventor: Jarle Wentzel, Drammen, Norway

[73] Assignee: Nodest Vei A/S, Lierstranda, Norway

[21] Appl. No.: 88,112

[22] PCT Filed: Nov. 26, 1986

[86] PCT No.: PCT/N086/00079

§ 371 Date: Sep. 11, 1987

§ 102(e) Date: Sep. 11, 1987

[87] PCT Pub. No.: WO87/03317

PCT Pub. Date: Jun. 4, 1987

[30] Foreign Application Priority Data

Nov. 29, 1985 [NO] Norway ..... 854807

[51] Int. Cl.[4] ..... B01F 3/14; B01F 5/24

[52] U.S. Cl. ..... 366/9; 366/2; 366/34; 366/37; 366/40; 366/337

[58] Field of Search ..... 366/2, 6, 9, 30, 33, 366/34, 37, 40, 336, 337, 338, 340, 341; 209/352, 356

[56] References Cited

U.S. PATENT DOCUMENTS

| | | | |
|---|---|---|---|
| 772,377 | 10/1904 | Rowland et al. | 209/356 X |
| 1,056,590 | 3/1913 | Sayers . | |
| 1,109,725 | 9/1914 | Whitney | 366/9 |
| 2,064,807 | 12/1936 | Barber . | |
| 3,129,779 | 4/1964 | Clements | 366/37 X |
| 4,096,588 | 6/1978 | Mendenhall | 366/37 X |
| 4,322,288 | 3/1982 | Schmidt | 209/356 |
| 4,387,996 | 6/1983 | Mendenhall | 366/37 X |

FOREIGN PATENT DOCUMENTS

| | | | |
|---|---|---|---|
| 0045732 | 2/1982 | European Pat. Off. . | |
| 2017372 | 10/1971 | Fed. Rep. of Germany . | |
| 1239981 | 7/1960 | France | 366/37 |
| 83/01909 | 6/1983 | PCT Int'l Appl. | 366/337 |
| 377820 | 4/1974 | Sweden . | |
| 422607 | 2/1982 | Sweden . | |
| 427328 | 3/1983 | Sweden . | |
| 16466 | of 1903 | United Kingdom | 366/9 |
| 581849 | 10/1946 | United Kingdom | 366/337 |
| 1238905 | 7/1971 | United Kingdom . | |

*Primary Examiner*—Harvey C. Hornsby
*Assistant Examiner*—Scott J. Haugland
*Attorney, Agent, or Firm*—Fleit, Jacobson, Cohn & Price

[57] ABSTRACT

A method and an apparatus for mixing gravel materials and bitumen. The gravel material is mixed with a bitumen emulsion by causing the gravel material to fall onto an inclined screen (12) separating coarse gravel particles (G) from fine gravel particles (g) in such a manner that the coarse gravel particles and fine gravel particles follow different paths of free fall while spraying bitumen separately onto the two gravel follows which then are reunited via oppositely inclined baffles (20, 22). Preferably the reunited bituminous gravel material is then sprayed with additional bitumen and then allowed to fall freely onto further baffles (26, 28).

5 Claims, 2 Drawing Sheets

METHOD AND AN APPARATUS FOR MIXING GRAVEL AND BITUMEN

Figure 1:
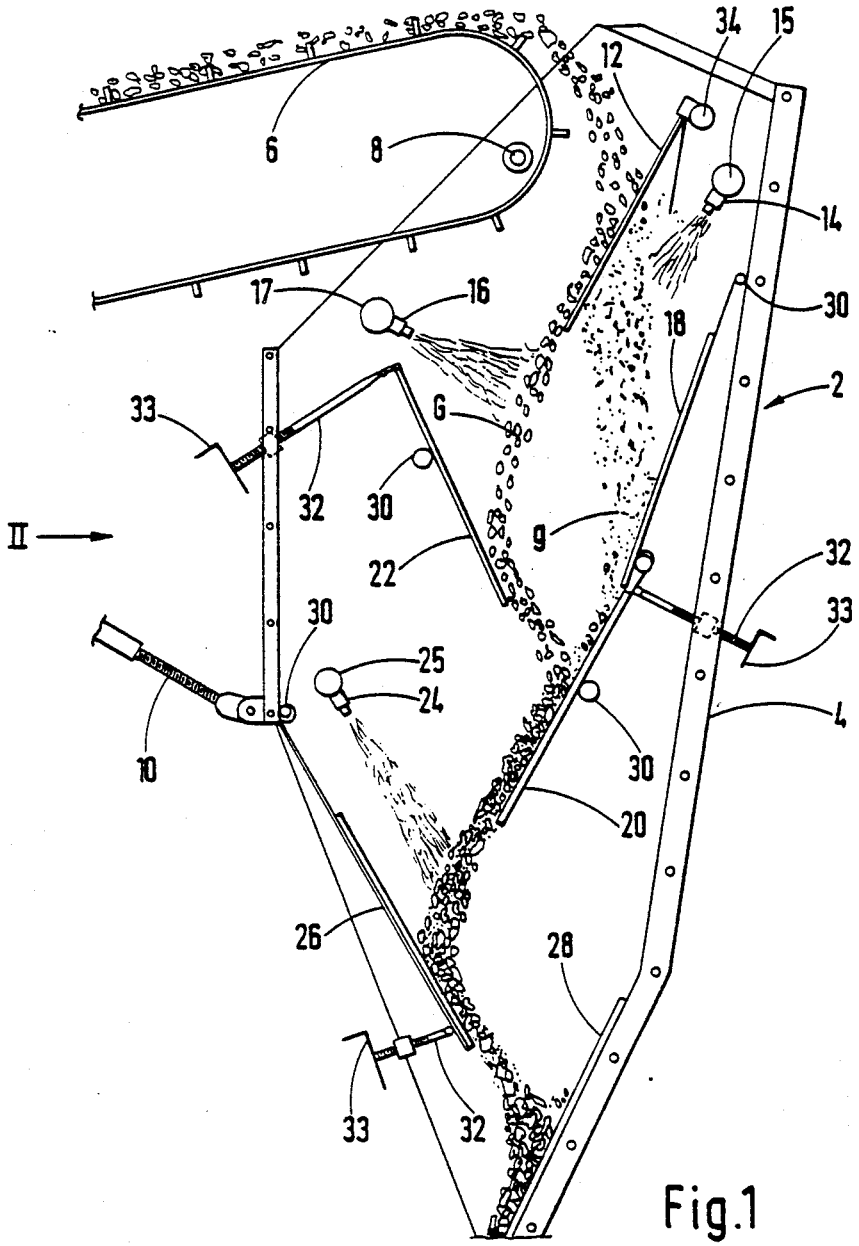

The present invention relates to a method and an apparatus for mixing gravel materials with liquid bitumen, for example in the form of an emulsion, for the purpose of using the mixed mass in road coatings or the like, the bitumen acting as a binding agent for the gravel material. The gravel material consists of particles of varying size, and the smallest particles tend to absorb a major part of the bitumen, leaving the larger particles insufficiently coated. Therefore a very thorough mixing is needed to obtain masses of sufficient quality.

Such masses are usually mixed in oil gravel works, socalled cold mixing works, with rotating mixing means mounted on horizontally extending shafts in a mixing trough. Owing to the capacities required from a such work its size and weight is considerable so that it is rather immobile. Also, high investment and production costs are involved resulting in an expensive mixture. As an example of such prior art Swedish patent No. 377 820 may be mentioned.

The object of the present invention is to provide a more simple, cheap and effective mixing system than those conventionally used, and this is achieved through a method and an apparatus as defined in the appending patent claims.

Admittedly, Swedish patent No. 427 328 discloses a method and an apparatus for continuous mixing a liquid into a pulverous material, in which the liquid is sprayed onto the pulverous materiale when the latter, in the form of a hollow cylindrical flow, is falling freely from a cone spreader, the liquid being ejected from nozzles located below the spreader. A such technique could also be contemplated for mixing bitumen emulsion into gravel, but this would not result in a sufficient mixing of the materials. An effective and sufficient mixing of the bitumen and gravel materials is obtained, however, by employing the novel features according to the present invention, i.e. initial separation of the gravel material into a coarse and a fine particle flow, and, after separately spraying bitumen emulsion onto the two gravel flows, final reunification and intermixing of the gravel flows by means of oppositely inclined baffles. In addition to securing an effective penetration and intermixing of the bitumen in the gravel materials the invention makes it possible to vary the amount of bitumen added to the coarse and fine particle flows respectively. Since the coarse particles generally requires considerably less bitumen than the fine particles, the above variation possibility may result in considerable savings in the consumption of bitumen which by far is the most expensive component of the mixture.

Figure 2:
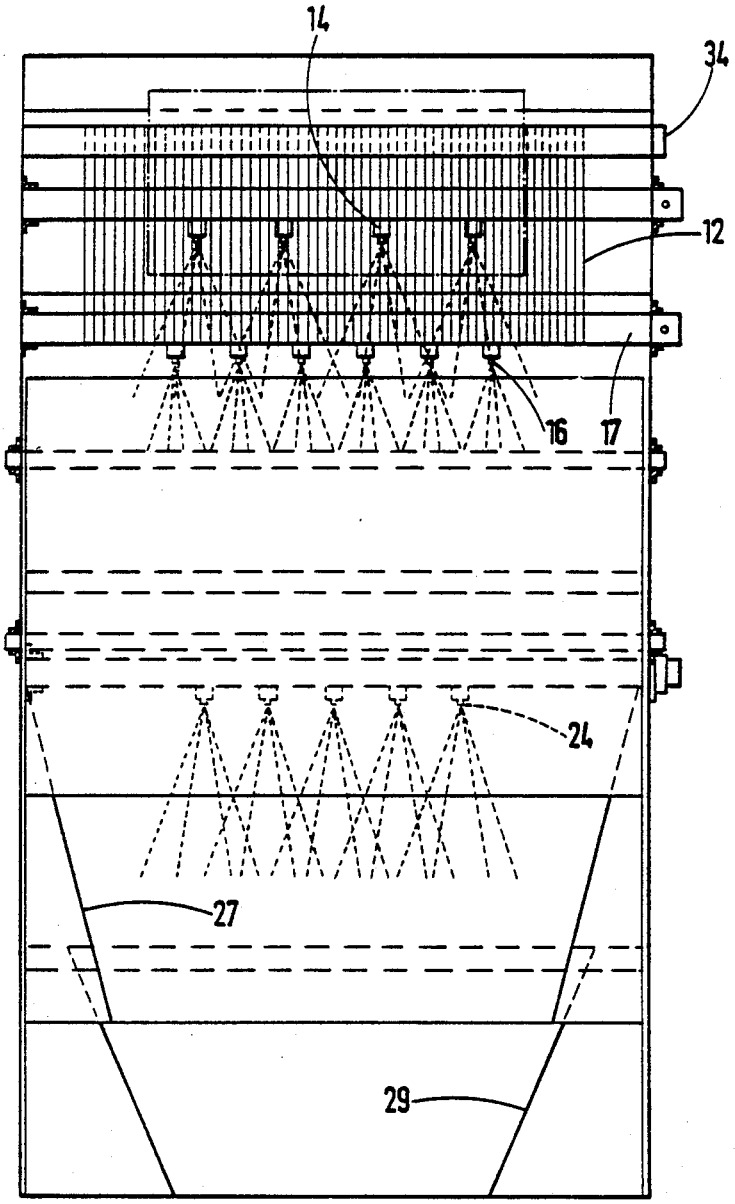

The invention is described more fully below with reference to the drawing in which:

FIG. 1 is a schematic side view of a preferred embodiment of an apparatus according to the invention, with side cover removed, and FIG. 2 is a front view of the apparatus, i.e. seen in the direction of the arrow II in FIG. 1, with some parts removed.

On the drawing the apparatus according to the invention is generally denoted by numeral 2. It consists of a plate housing or frame 4 of substantially rectangular crossection pivotably suspended at its upper end directly below the outlet end of a belt conveyor 6, for example by means of an upper through going shaft or bolt 8 and a lower threaded adjustment bolt 10 which is connected to the belt conveyor support (not shown).

In frame 4 there are mounted a number of components which will be described below in connection with the operation of the apparatus.

The gravel material to be mixed with bitumen is metered from a calibrated feed station (not shown) onto the belt conveyor 6. From the outlet end of the belt conveyor the material falls down onto a grading device in the form of an inclined screen 12 adapted to separate coarser gravel particles from finer ones. The screen 12 may for example be adapted to let through fine gravel particles "g" smaller than 8 mm while coarse gravel particles "G" larger than 8 mm slide along the upper side of the inclined screen and continue as a free fall flow separated from the fine gravel "g".

When falling from the screen 12 the fine gravel "g" and coarse gravel "G" is sprayed with bitumen from separate sets of spraying nozzles 14 and 16 respectively mounted on transverse pipes 15 and 17 respectively.

The fine gravel "g" falls substantially vertically down onto an inclined baffle 18 one end of which rests on the end of a further inclined baffle 20. The coarse gravel "G" in its turn impinges on a third baffle 22 which is inclined opposite of the fine gravel baffles 18, 20, and is positioned such that the coarse gravel "G" falls from the baffle 22 obliquely onto the baffle 20 where it is reunited and mixed with the fine gravel "g". From the inclined baffle 20 the fine gravel and coarse gravel continue together in a free fall, well mixed with bitumen, and might be utilized as a road material in this state.

However, in order to secure an even more thorough mixing the preferred embodiment is shown to be provided with a further set of bitumen nozzles 24 mounted on a transverse pipe 25, spraying bitumen on the decending free fall material flow. Further, there are preferably arranged additional inclined baffles 26 and 28 before the material flow discharges from the bottom of the frame 4. The two lower baffles 26 and 28 preferably have converging side plates 27, 29 compacting the material flow and preventing separation of the materials therein.

Preferably, all baffles 18, 20, 22, 26 apart from the last one 28, are pivotably supported through transverse pivot shafts 30 for adjusting desired, proper inclination relative to each other. Adjustment may for example occur by means of threaded bolts 32 one end of which engages the end portion of the baffles the other end being provided with crank means 33 or the like. Preferably, also the screen 12 is pivotably supported at its upper end by a shaft 34.

All baffles are preferably coated with low friction wear material such as a hard plastic on the side facing the gravel flow.

What we claim is:

1. An apparatus for mixing gravel material and bitumen, comprising a device (12) for spreading the gravel material and a plurality of nozzles (16, 14) located below the spreading device for spraying bitumen onto the gravel material while the latter is falling freely from the spreading device, characterized by said spreading device being an inclined screen (12) adapted to separate the gravel material into a coarse gravel flow (G) and a fine gravel flow (g), such that these flows during their fall from the screen (12) follow different paths along which said nozzles (16, 14) are arranged for separate spraying of bitumen on the coarse gravel flow (G) and fine gravel flow (g) resepectively, and by at least one inclined baffle (18, 20) for the fine gravel flow and an oppositely inclined baffle (22) for the coarse gravel flow, said baffles being oriented such that the two gravel flows are reunited to form a common falling gravel material flow mixed with bitumen.

2. An apparatus according to claim 1, characterized by comprising a further set of nozzles (24) for spraying bitumen on the reunited falling gravel material flow.

3. An apparatus according to claim 2, characterized by comprising at least one additional baffle (26, 28) for the reunited gravel material flow.

4. An apparatus according to claim 3 wherein said additional baffle (28) has converging side walls (29).

5. An apparatus according to claim 1, characterized by said screen (12) and baffles (18, 20, 22, 26) being pivotable for adjusting the inclination thereof.

* * * * *